United States Patent [19]

Taplin

[11] Patent Number: 4,516,605

[45] Date of Patent: May 14, 1985

[54] FOUR-WAY CONTROL VALVE

[76] Inventor: John F. Taplin, 15 Sewall St., West Newton, Mass. 02165

[21] Appl. No.: 602,654

[22] Filed: Apr. 20, 1984

[51] Int. Cl.[3] ..... F15B 13/043

[52] U.S. Cl. ..... 137/596.15; 91/454; 137/596.16; 137/596.17; 137/625.44

[58] Field of Search ..... 91/454, 461, 467; 137/106, 596.14, 596.15, 596.16, 596.17, 625.2, 625.44, 625.65, 870; 251/24, 61.1

[56] References Cited

U.S. PATENT DOCUMENTS

| | | | |
|---|---|---|---|
| Re. 29,481 | 11/1977 | Larner | 137/596.15 |
| 2,881,740 | 4/1959 | Ensinger | 137/82 X |
| 2,970,611 | 2/1961 | Hoge . | |
| 2,984,257 | 5/1961 | McCormick . | |
| 3,216,440 | 11/1965 | Kohman | 137/596.14 X |
| 3,265,089 | 8/1966 | Nill | 137/596.16 |
| 3,455,330 | 7/1969 | Williams et al. | 137/596 |
| 4,076,046 | 2/1978 | Hieronymus et al. | 137/596.17 X |
| 4,085,952 | 4/1978 | Sharples | 137/625.44 X |
| 4,131,130 | 12/1978 | Ruby | 137/596.17 |
| 4,285,363 | 8/1981 | Kolm | 137/596.17 |
| 4,343,329 | 8/1982 | Turansky et al. | 137/625.44 |

FOREIGN PATENT DOCUMENTS

| | | | |
|---|---|---|---|
| 1229952 | 9/1960 | France | 137/625.2 |

*Primary Examiner*—Gerald A. Michalsky

*Attorney, Agent, or Firm*—Hamilton, Brook, Smith & Reynolds

[57] ABSTRACT

A four-way control valve comprises two side by side chambers 130, 132. Each chamber has high and low pressure inlet ports 151, 156, 157, 159 and an outlet port 162, 164. The high and low inlet ports of each chamber are alternately closed by respective flexible vanes 126, 128. The vanes extend through and pivot on walls 135, 137 of the chambers and the opposite ends of the vanes are joined by a linking bar 124. The linking bar is driven by a common actuator such as a solenoid 120. The pressures applied to the inlet ports of the chambers are inverted such that the pressures at the two outlet ports are opposite high and low pressures. The four-way valve may serve as a pilot valve 22 to actuate a higher flow capacity three or four-way diaphragm valve.

8 Claims, 6 Drawing Figures

FOUR-WAY CONTROL VALVE

CROSS REFERENCE TO RELATED APPLICATION

Pilot Operated Supply and Waste Control Valve, Ser. No. 602,438, filed Apr. 20, 1984.

DESCRIPTION

1. Technical Field

The present invention relates to fluid control valves and in particular to four-way valves.

2. Background

Control valves are widely used to apply high pressure fluid to one or more load conduits and thereafter exhaust that fluid from the load conduits. In three-way valves, the fluid is alternately supplied to and exhausted from a single conduit; in four-way valves, the fluid is supplied to one conduit as it is exhausted from another conduit, and thereafter the fluid is exhausted from the first conduit and supplied to the second conduit. Such valves have many uses, but a primary use is as a directional control valve which supplies and exhausts fluid to and from each end of a cylinder to drive a piston. As high pressure fluid is applied to a first end of the cylinder, it is exhausted from the a second end to drive the piston in a first direction. Thereafter, the high pressure fluid is supplied to the second end of the cylinder and exhausted from the first to drive the piston in the opposite direction.

Large three and four-way control valves are themselves generally controlled by one or more pilot valves. The pilot valves may be three-way or four-way valves, and they may be actuated manually, by a fluid, by a solenoid, or by any other drive mechanism.

One form of pilot operated four-way valve is shown in my prior U.S. Pat. No. 4,169,490. The valve shown in that patent includes four poppet valves which are driven pneumatically through respective diaphragms. The control pressures applied to the diaphragms can be obtained from a relatively simple pilot valve because a single pressure can be applied to each of the four diaphragms. The reverse operation of the valves required to close waste valves while supply valves are open and vice versa can be obtained by the mechanical arrangement of the poppet valves themselves. A disadvantage of poppet valves is that the poppets add to the expense of the system. Further, their large mass, relative to diaphragm valves, results in harder pounding of the poppet valves and thus increased wear. Therefore, in many applications a more simple and smaller mass diaphragm valve may be preferred despite the more complicated controls required for such systems.

One form of four-way valve in which the main valve members are diaphragms is shown in U.S. Pat. No. 2,911,005 to Adelson. In that system, a first pilot valve alternately applies high and low control pressures to the back, control faces of one pair of diaphragms. A second pilot valve responds to that control pressure to supply a reversed, low or high, pressure to the control faces of another pair of diaphragms. A significant disadvantage of the Adelson system is that it requires two externally supplied pressure levels above the pressure level of the supply fluid to operate the second pilot valve and also control the main diaphragm valves.

Another form of four-way valve wherein the main valving elements are diaphragms is shown in U.S. Pat. No. 3,016,918 to Wentworth. The Wentworth valve utilizes the pressure of the supply fluid to derive the control pressures to be applied behind the diaphragm valves. A disadvantage of the Wentworth and similar systems is that they require several flow restrictions in the control lines. Where the supply fluid contains foreign materials such as sand, grit, gums or varnish, which is generally the case in industrial applications, those restrictions are subject to clogging. If filter elements are used to clean the supply fluid applied to the control network, those filters must be replaced or cleaned periodically.

Yet another form of pilot operated four-way valve wherein diaphragms are used as the main valving elements is shown in U.S. Pat. No. 2,984,257 to McCormick et al. In that system the control pressures are also derived from the supply fluid. Restrictions in the control network are avoided by the use of two separate but similar pilot valves, wherein the pilot valves are operated by two separate independent solenoids. A disadvantage of that arrangement is that it requires two solenoids, or two other separate mechanically applied forces, to actuate these two separate pilot valve mechanisms. The two solenoids add to cost, to the complexity of the overall system and to maintenance requirements. It is therefore advantageous, even where solenoids are used to actuate the pilot valve, to provide a system that uses only one solenoid or, if the system is to be operated by some manual means, to provide a system that requires only a single "operator" to actuate a single pilot valve.

Yet another form of piloted four-way control valve utilizing diaphragms as the main valve elements is shown in U.S. Pat. No. 4,385,639 to Holborow and U.S. Pat. No. Re. 29,481 to Larner. In those systems, the control pressures are obtained from pilot spool valves. The high control pressures are derived from the supply fluid. Sliding parts of spool valves require clean fluid because they are prone to "spool" or "disk" sticking due to the effects of varnish and fine particulate matter. If filters are used, they must be replaced or cleaned periodically.

DISCLOSURE OF THE INVENTION

In accordance with principles of the present invention, a four-way control valve includes two output pressure chambers, each having high and low pressure inlet ports and an outlet port. Each output pressure chamber has a valve member which comprises a pivotal arm for alternately closing the high and low pressure ports. Pivotal arms are simultaneously driven by a common actuator to close the high pressure port to one chamber while closing the low pressure port to the other chamber and vice versa.

In the preferred embodiment, the controlled pressure chambers are positioned side by side, and the pivotal arms extend generally parallel from the control pressure chambers. The arms are joined by a linking bar which is driven by a solenoid or by a pressure responsive element or by manual means. The ends of the pivotal arms within the output pressure chambers swing between opposing valve seats at high and low pressure ports. The positions of the high and low pressure ports in the two chambers are inverted relative to each other.

In one form of the invention, the four-way valve serves as a pilot valve to a larger supply and waste control valve. Preferably, all of the main valves are diaphragm valves which are controlled by high and low pressures applied to the faces of the diaphragms opposite to their valving faces. The pilot valve controls the fluid pressure applied to these diaphragm faces to open and close a supply diaphragm valve associated with each load port while conversely closing and opening a waste diaphragm valve associated with each load port.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DESCRIPTION OF PREFERRED EMBODIMENTS

A four-way control valve embodying this invention is shown in FIGS. 1–5. In this case, the valve is controlled by a solenoid coil 120 but it might also be operated manually or pneumatically employing a pressure responsive element. When the solenoid coil 120 is actuated, it pulls up on its center rod 122 to pull up on a bar 124. The bar 124 in turn pushes up on two rocker arms 126 and 128.

Figure 1:
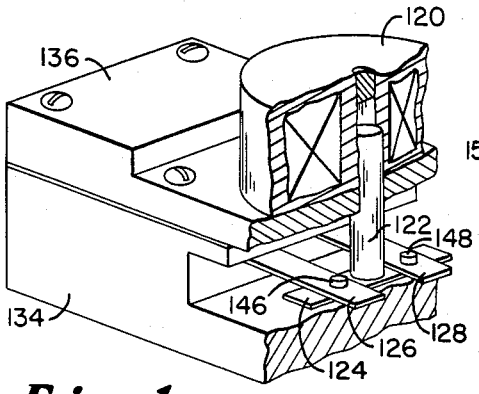
FIG. 1 is a perspective view, partially broken away, of an embodiment of the invention controlled by a solenoid.
Figure 2:
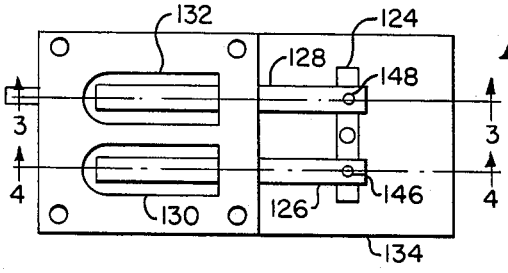
FIG. 2 is a cross sectional plan view of the embodiment of FIG. 1 taken along line 2—2 in FIG. 3.
Figure 3:
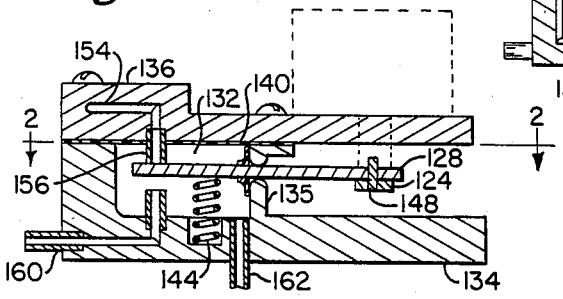
FIG. 3 is a cross sectional view taken along line 3—3 of FIG. 2 and showing one output pressure chamber.
Figure 4:
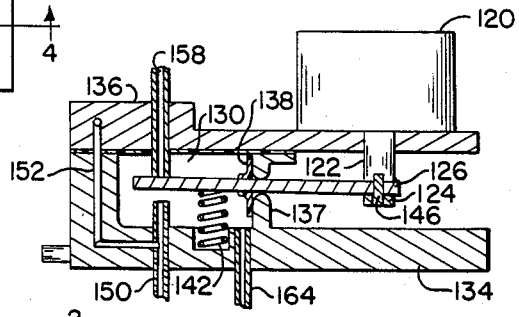
FIG. 4 is a cross sectional view of the valve taken along line 4—4 of FIG. 2 and showing the other output pressure chamber.

As can be seen in FIGS. 3 and 4, the rocker arms 126 and 128 extend into respective output pressure chambers 130 and 132 formed in a lower block 134 and closed by an upper block 136. The rocker arms extend through and pivot on walls 135, 137 to those chambers formed on the block 134. The output pressure chambers are sealed about the rocker arms by elastomeric collars 138 and 140. When the solenoid 120 is relaxed, the rocker arms are pivoted by compression springs 142 and 144 to the position shown in the figures. Alternatively, a single spring can be positioned around the bottom end of the armature 122 to push the bar 124 downward.

The rocker arms, or vanes, are connected to the arm 124 by respective pins 146 and 148. These pins are interference fit into the bar 124 but are loosely fit in the vanes 126 and 128. With this arrangement, when the solenoid is relaxed, the positions of the vanes are determined by the springs 142 and 144 and the valve seats against which the vanes are pressed independent of the solenoid rod 122. On the other hand, the bar 124 serves as an equalizing bar which assures that both vanes are pressed firmly against their respective lower valve seats when the solenoid is actuated. If the linking bar and the rocker arms were rigid and tightly joined, proper seating of both bars simultaneously against their respective valve seats would be virtually impossible. The first arm to contact a valve seat would prevent further pivoting of the other arm and would thus prevent the other arm from being firmly seated. This same equalization can be accomplished by having flexibility in one or both arms, eliminating the need for any other equalization means.

Figure 5:
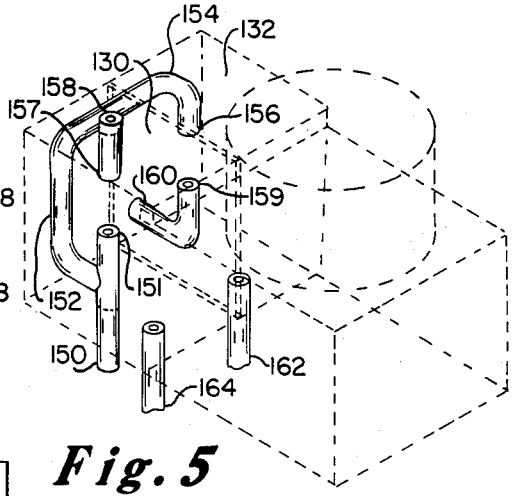
FIG. 5 is a schematic illustration of the fluid ports leading to the two output pressure chambers of the system of FIGS. 1 through 4.

Porting to the two output pressure chambers 130 and 132 can be best seen in FIG. 5. High pressure is applied to a conduit 150 directly into the chamber 130 through port 151. High pressure is also applied through a vertical conduit 152 in the block 134 and a horizontal conduit 154 in the upper block 136 to an upper high pressure port 156 in chamber 132. Thus, high pressure ports are located in the bottom of chamber 130 and in the top of chamber 132. On the other hand, low pressure ports 157 and 159 are vented directly to atmosphere or a lower pressure through a conduit 158 in the top of chamber 130 and through a conduit 160 in the bottom of chamber 132.

It can be seen from the above that, when the solenoid 120 is relaxed, the high pressure port 156 to chamber 132 is closed and chamber 132 is vented to atmosphere or other low pressure. Low pressure is therefore applied to a first outlet conduit 162. At the same time the low pressure port 157 to chamber 130 is closed and high pressure is applied through line 150 to that chamber. High pressure is thus applied to a second outlet conduit 164. When the solenoid is then actuated, the opposite ports to those chambers are closed so that high pressure is applied to outlet conduit 162 and low pressure is applied to outlet conduit 164.

The use of dual rocker arms in this four-way valve presents several advantages. As already noted, the flexible rocker arms or the equalizer bar 124 allow both valve members to be firmly seated while using a common actuator. Further, rocker arms allow for a simple valve member and actuator assembly without the need for sliding parts which are very vulnerable to wear, foreign materials in the fluid, and binding. With rocker arms, nearly static seals 138 and 140 provide durable, consistent sealing of pressure in the chambers.

One use of the four-way valve of FIGS. 1–5 is as a directional control valve for driving a reciprocating piston in a cylinder. In such an arrangement, one outlet conduit 162 would be connected to one end of the piston cylinder and the other outlet conduit 164 would be connected to the opposite end of the cylinder. With high pressure thus applied to one end of the cylinder and the fluid vented from the other end of the cylinder, the piston would be driven in one direction. Then, with the solenoid, pressure responsive element or manual element actuated, the fluid pressures applied to the opposite ends of the cylinder would be reversed so that the piston would be driven in the opposite direction.

Figure 6:
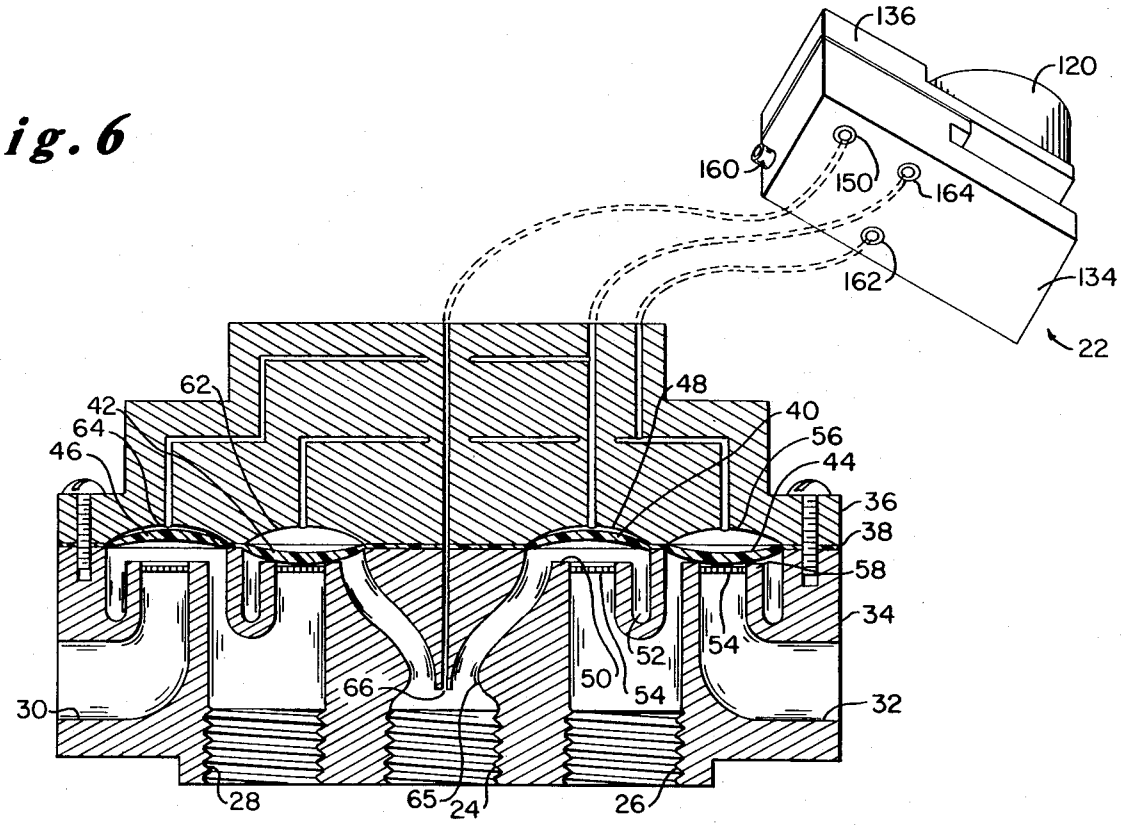
FIG. 6 is an illustration of the control valve of FIGS. 1 through 5 serving as a pilot valve to a main diaphragm valve assembly.

The valve of FIGS. 1–5 is designed for low flow rates to and from the outlet conduits 162 and 164. To handle larger flow rates, the valve of FIGS. 1–5 may serve as a pilot valve to a main valve. An example is shown in FIG. 6 where all of the main valves are diaphragm valves. The system of FIG. 6 is a pilot operated four-way supply and waste control valve.

FIG. 6 shows the response of the main control valve to a high pressure at the outlet port 162 and a low pressure at port 164. In that case, supply fluid, which may be hydraulic or pneumatic, is directed from a supply port 24 to a load port 26. From the port 26, the supply fluid may be applied, for example, to one end of a piston cylinder. At the same time, waste fluid is vented from a load port 28 to a waste port 30. The port 28 may, for example, be connected to the opposite end of a piston cylinder.

If the control pressures from the pilot valve 22 are reversed, the valving of the supply and waste ports to the two load ports 26 and 28 is reversed. Specifically, the supply fluid is applied to the port 28, and port 26 is vented through a waste port 32. Waste ports 30 and 32 may be connected so that the valve operates as a four port control valve with one supply port, one waste port and two load ports.

The main valve assembly comprises a lower main valve block 34 and an upper control block 36. The conduits in block 36 are actually three dimensional but are shown on a single plane for purposes of illustration. Cross non-connections of conduits are indicated by broken lines.

The blocks 34 and 36 are separated by a gasket 38. Four diaphragms are formed in that gasket. They include two supply diaphragms 40 and 42 and two waste diaphragms 44 and 46. The positions of those diaphragms are controlled by high and low pressures applied to their upper surfaces through conduits in the control block 36. For example, as shown in FIG. 6, a low pressure is applied to the control chamber 48 behind the diaphragm 40 and the diaphragm is pushed away from its annular valve seat 50 by the higher supply pressure applied to the annulus 52 from the supply port 24. The supply fluid is therefore free to flow through a grid 54 into the load port 26 and to the load connected to that port. High pressure is applied to the control chamber 56 on top of the waste valve 44 associated with the load port 26. That high control pressure presses the diaphragm 44 against its annular valve seat 58 to close the passage from the port 26 to the waste port 32. The diaphragm rests against the grid 54 to minimize stress on the diaphragm due to the pressure differential between the control chamber 56 and the waste port 32.

It can be seen that the supply and waste valves associated with load port 28 are operated conversely to those associated with port 26. Thus, high pressure is applied to the control chamber 62 to close that supply diaphragm valve, and low pressure is applied to the control chamber 64 on top of diaphragm 46 to open that waste valve. When the control pressures from pilot valve 22 are reversed, the supply diaphragm valve to port 26 is closed while the waste diaphragm valve from port 26 is open, and the supply diaphragm valve to port 28 is open while the waste diaphragm valve from that port is closed.

The derivation of the "ram elevated" control pressures will now be described. It should first be noted that the valve shown in FIG. 6 is self-powered in that the control pressures are ambient pressure and a high pressure obtained from the supply fluid applied to port 24. To that end, a ram nozzle 66 is directed into the supply fluid at a point. The resultant pressure in the high pressure control conduit 150 is higher than that at the supply port 24 by a ram pressure $\Delta P$. The ram pressure $\Delta P$ can be defined by the following function:

$$\Delta P = \tfrac{1}{2}(Q/A_T)^2(\rho/g) \qquad (1)$$

where Q is the supply fluid flow at an absolute pressure Pa, $A_T$ is the total flow area of supply fluid at the end of the ram nozzle, $\rho$ is the fluid density at Pa and g is acceleration due to gravity. The ram elevated pressure $Pa+\Delta P$ obtained in the ram nozzle 66 is applied to port 150 of the pilot valve and then throughout the control conduits. The higher pressure is also applied to selected control chambers to actuate the diaphragm valves.

In a typical case, the system of FIG. 6 might provide a flow rate of 590 cubic inches per second through a flow area $A_T$ of 0.2 square inches where the absolute pressure of the supply fluid is 99.7 pounds per square inch. From equation 1, where the supply fluid is air:

$$\Delta P = 1/2\,(590/.2)^2\,(3.3 \times 10^{-4})/384$$
$$= 3.74 \text{ pounds per square inch}$$

Thus, the control pressure applied to the diaphragms exceeds the supply pressure by at least three pounds per square inch to assure adequate seating of the diaphragms against the valve seats.

Several notable features of the valve of FIG. 6 contribute to the reliable, self-powered nature of the piloted control. A control pressure higher than the supply pressure is obtained by the ram nozzle. All control conduits have substantial bores; no restrictions in those conduits are required. The system has no sliding parts. Further, only two pressure levels are required, the higher supply pressure and low, ambient pressure. No additional pressures, which would complicate the system, are required to actuate the four main diaphragm valves.

While the invention has been particularly shown and described with reference to a preferred embodiment thereof, it will be understood by those skilled in the art that various changes in form and details may be made therein without departing from the spirit and scope of the invention as defined by the appended claims. For example, any form of actuator could be used to operate the valve. Also, the main valves function equally well when the flow paths in an annulus and the associated inner valving port are interchanged. Further, the main diaphragm valve can be modified according to teachings in my U.S. patent application entitled Pilot Operated Supply and Waste Control Valve Ser. No. 602,438, filed Apr. 20, 1984.

I claim:

1. A pilot operated supply and waste control valve of the type comprising two main valves associated with at least one load port for alternately supplying and exhausting a supply fluid to and from each load port and control means for applying fluid control pressure to open and close a main supply valve associated with each load port while conversely closing and opening a main waste valve associated with each load port, wherein:

each main valve comprises a diaphragm which presses against a valve seat with a high pressure applied to a control surface of the diaphragm opposite to the valve seat; and the control means is a four way pilot valve comprising:

first and second output pressure chambers, each having a high pressure inlet port in communication with a source of said supply fluid, a low pressure inlet port and an output control conduit for applying opposite high and low pressures to the control surfaces of the diaphragms of said main supply and waste valves associated with each load port;

a valve member associated with each output pressure chamber, each valve member comprising an arm having a first end thereof positioned between the high and low pressure inlet ports, a second end, and a fluid sealed pivot between the first and second ends, the arm being pivoted about the pivot to move said first end alternately against the high and low pressure inlet ports to alternately close the ports; and one actuator for simultaneously driving the second ends of the pivotal arms of the respective valve members such that the high pressure port to one output pressure chamber is closed by one valve member arm as the opposite, low pressure port to the other output pressure chamber is closed by the other valve member arm such that one of the main supply and waste valves of each load port is opened due to the resultant pressure in one of the chambers and the other of the main supply and waste valves of each load port is closed due to the resultant pressure in the other chamber.

2. A supply and waste control valve as claimed in claim 1 wherein the output pressure chambers are positioned side by side, the pivotal arms extend generally parallel from the output pressure chambers and the pivotal arms are joined at ends opposite to the output pressure chambers by a linking bar.

3. A supply and waste control valve as claimed in claim 2 wherein the linking bar is driven by a solenoid.

4. A supply and waste control valve as claimed in claim 1 wherein ends of the pivotal arms within the output pressure chambers swing between opposing valve seats at high and low pressure ports.

5. A supply and waste control valve as claimed in claim 4 wherein the output pressure chambers are positioned side by side, the pivotal arms extend generally parallel from the output pressure chambers and the pivotal arms are joined at an end opposite to the output pressure chambers by a linking bar.

6. A supply and waste control valve as claimed in claim 1 wherein at least one pivotal arm is a flexible vane.

7. A supply and waste control valve as claimed in claim 1 having two load ports.

8. A supply and waste control valve as claimed in claim 1 wherein each main valve is a diaphragm valve.

* * * * *